US006986183B2

(12) United States Patent
Delgorgue et al.

(10) Patent No.: US 6,986,183 B2
(45) Date of Patent: Jan. 17, 2006

(54) ARTICLE OF FOOTWEAR AND METHOD OF MANUFACTURING SAME

(75) Inventors: Gerald Delgorgue, Ruffieux (FR); Catherine Fellouhe, Vieugy (FR)

(73) Assignee: Salomon S.A., Metz-Tessy (FR)

( * ) Notice: Subject to any disclaimer, the term of this patent is extended or adjusted under 35 U.S.C. 154(b) by 2 days.

(21) Appl. No.: 10/023,865

(22) Filed: Dec. 21, 2001

(65) Prior Publication Data

US 2002/0078599 A1 Jun. 27, 2002

(30) Foreign Application Priority Data

Dec. 22, 2000 (FR) ..... 00 17127

(51) Int. Cl.
*A43B 23/02* (2006.01)
*A43B 23/06* (2006.01)
*A43B 23/16* (2006.01)

(52) U.S. Cl. ..... 12/146 C; 12/142 K; 36/45; 36/98

(58) Field of Classification Search ..... 36/98, 36/45, 3 A; 12/146 C, 142 K, 142 V, 14 CD
See application file for complete search history.

(56) References Cited

U.S. PATENT DOCUMENTS

| | | | | |
|---|---|---|---|---|
| 3,224,117 | A * | 12/1965 | Dassler | 36/98 |
| 3,570,149 | A * | 3/1971 | Kogert et al. | 36/98 |
| 3,627,567 | A * | 12/1971 | Tensho | 12/142 V |
| 4,321,721 | A * | 3/1982 | Painter et al. | 12/146 C |
| 4,438,574 | A * | 3/1984 | Johnson | 36/45 |
| 4,858,337 | A * | 8/1989 | Barma | 36/4 |
| 4,899,411 | A | 2/1990 | Johnson et al. | |
| 4,901,450 | A * | 2/1990 | Chemello et al. | 12/146 R |
| 5,235,715 | A * | 8/1993 | Donzis | 12/142 R |
| 5,253,434 | A | 10/1993 | Curley, Jr. et al. | |
| 5,743,027 | A * | 4/1998 | Barma | 36/4 |
| 6,167,640 | B1 * | 1/2001 | Schaefer | 36/98 |
| 6,401,364 | B1 * | 6/2002 | Burt | 36/3 A |
| 6,558,784 | B1 * | 5/2003 | Norton et al. | 36/45 |

FOREIGN PATENT DOCUMENTS

| | | |
|---|---|---|
| FR | 598761 | 12/1925 |
| FR | 726292 | 5/1932 |

* cited by examiner

*Primary Examiner*—Anthony Stashick
(74) *Attorney, Agent, or Firm*—Greenblum & Bernstein, P.L.C.

(57) ABSTRACT

A shoe and a method of coating a shoe. The method includes assembling the upper on the sole; applying at least one layer of flexible or semi-rigid polymer in liquid state in predetermined areas of the upper; and allowing the polymer to dry. The polymer is applied with a brush or by spraying. Preferably, the polymer is applied so as to straddle the upper and the sole.

34 Claims, 2 Drawing Sheets

FIG. 3
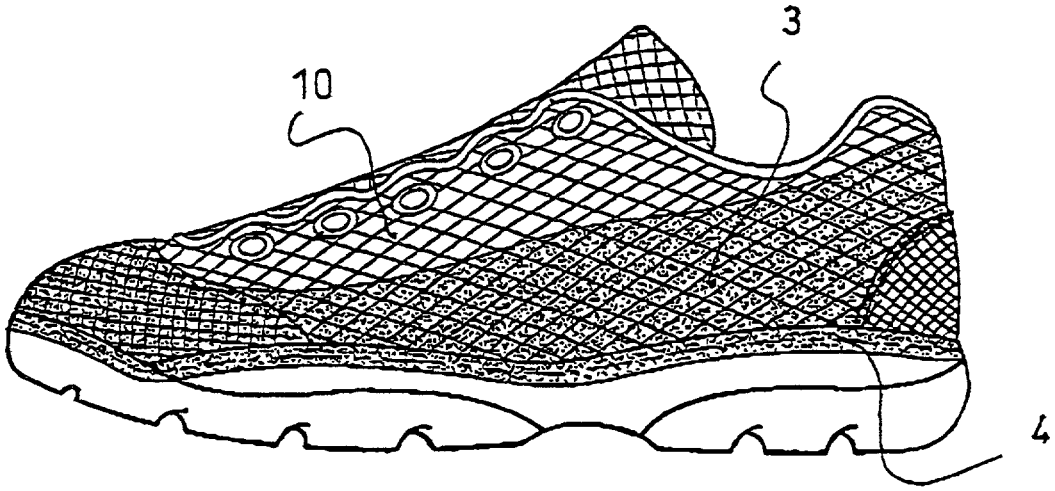
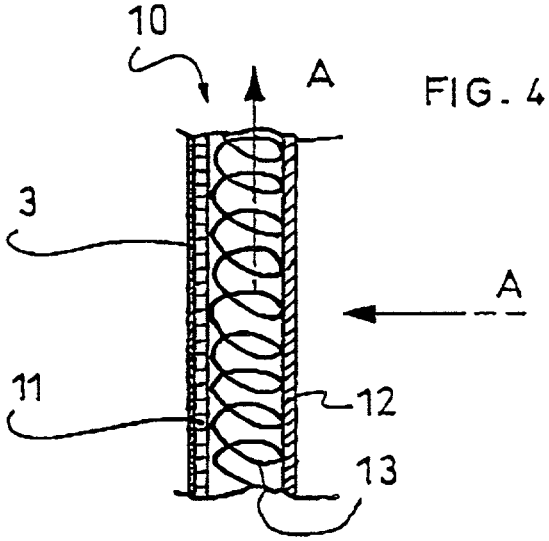
FIG. 4

ARTICLE OF FOOTWEAR AND METHOD OF MANUFACTURING SAME

CROSS-REFERENCE TO RELATED APPLICATION

This application is based upon French Patent Application No. 00 17127, filed on Dec. 22, 2000, the disclosure of which is hereby incorporated by reference thereto in its entirety, and the priority of which is hereby claimed under 35 U.S.C. §119.

BACKGROUND OF THE INVENTION

1.Field of the Invention

The invention relates to an at least partially reinforced or impervious shoe adapted for walking or hiking. More particularly, the invention is directed to an article of footwear, such as an article of footwear and a method of manufacturing same.

2. Description of Background and Relevant Information

Various methods are known for making a shoe impervious. They include, for example, providing an inner liner made of a breathable and impervious material; but this construction is costly because the breathable and impervious material is very expensive and all the seams must be made impervious by sealing joints added by gluing.

Another method is to immerse the finished boot into a latex or PVC bath, up to the desired level of imperviousness. This construction is also expensive to implement, because it requires a very long processing time and costly investments.

In the context of the invention, "impervious" means resistant to water penetration; one may wish this resistance to be more or less substantial depending on the use intended for the shoe.

For hiking or walking shoes, it is also desired that the upper be reinforced against substantial abrasion effects which are caused, for example, by the presence of stones, rocks, etc. This is true even if the upper is made out of a thick and presumably resistant material such as leather, or reinforced textile known by the commercial name "Cordura."

For lighter shoes for sports, leisure, or racing in the mountains, which are made of ventilated materials, this problem of resistance to abrasion is even more crucial. The shoes are used, for example, for racing in the mountains during sporting events called "raids," and are designed primarily to enable a good aeration/ventilation of the foot. They are generally made out of ventilated materials of the mesh/net type commonly called "mesh" for a good ventilation.

However, materials of this type are particularly fragile and not resistant to wear due, in particular, to abrasion. These materials also have the disadvantage of being very flexible and of inadequately retaining the foot.

Therefore, for this type of shoe using mesh-type materials, one seeks to reinforce the strength and resistance to wear/abrasion.

For these same materials, one also seeks to improve the resistance to the penetration of water or dirt (stones, dust, sand, etc.), without negatively affecting the breathability/ventilation of the shoe.

Finally, one desires to reinforce the shoes, while making it possible to preserve, or even to improve the aesthetic aspect thereof, which is not the case with the known sealing methods where the shoe is immersed in a latex of PVC bath, and, as a result, has a straight and unaesthetic parting line between the reinforcing material and the remainder of the upper.

SUMMARY OF THE INVENTION

An object of the present invention is to remedy the aforementioned disadvantage. To this end, type invention proposes a new method for coating a shoe of the type having an upper and a sole, including the following:

assembling the upper on the sole;

applying at least one layer of flexible or semi-rigid polymer in liquid state in predetermined areas of the upper;

drying.

Such a coating method is particularly flexible to implement and does not require any complicated equipment such as a bath, because the polymer is applied as a layer on the assembled shoe, either with a brush or by spraying.

It allows for decorative effects, since the polymer layer(s) can be applied exactly in the desired areas, and it makes it possible to avoid the straight lines resulting from the immersion coating methods.

BRIEF DESCRIPTION OF DRAWINGS

The invention will be better understood and other characteristics thereof will become apparent from the description that follows, with reference to the annexed schematic drawings, in which:

FIG. 3 is a side view of a shoe according to a second embodiment;

FIG. 4 is a cross-sectional view along the line IV—IV of FIG. 3.

DETAILED DESCRIPTION OF THE INVENTION

Figure 1:
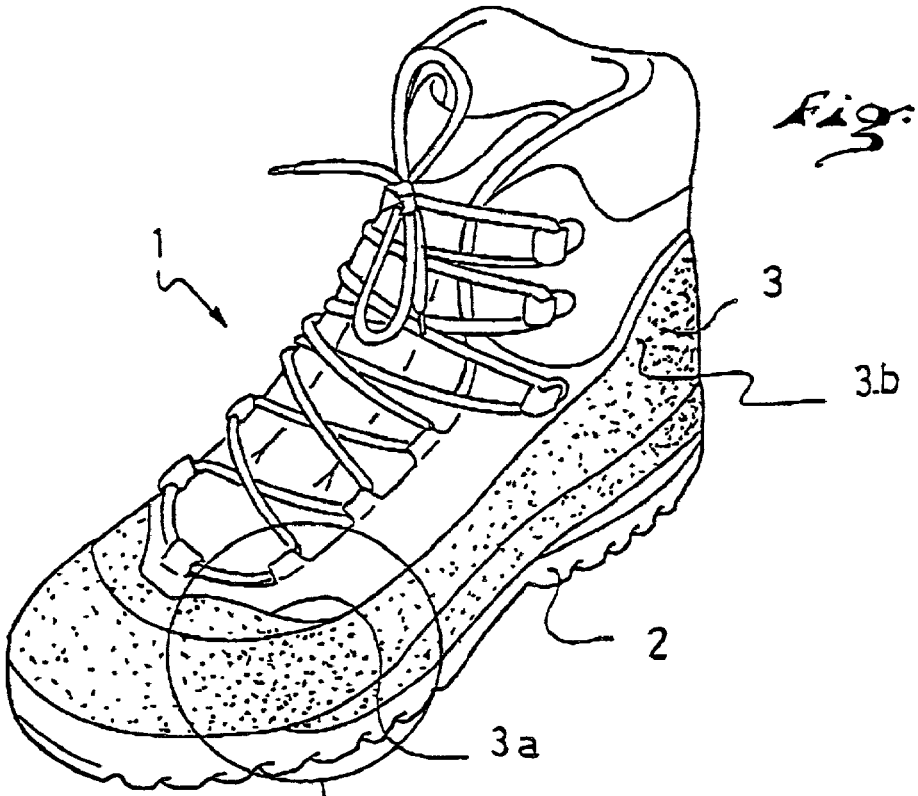
FIG. 1 is a perspective view of a shoe obtained by means of the method according to the invention, according to a first embodiment.
Figure 2:
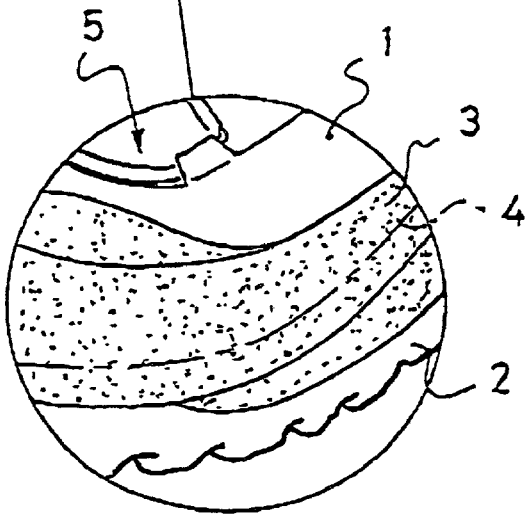
FIG. 2 is a detailed view of FIG. 1.

The shoe or article of footwear shown in FIGS. 1 and 2 is constituted, in a known manner, of an upper 1 and of an outer sole 2 assembled to the upper by cementing or molding. The illustrated embodiment includes a lacing 5 for tightening the upper upon the foot. Once the shoe is assembled, i.e., the sole 2 is fixed, by cementing or molding, on the upper 1, at least one layer 3 of polymer in liquid state is applied in predetermined areas of the upper. The assembly is then allowed to dry until curing of the polymer layer(s). This polymer is flexible or semi-rigid to adapt to the bending movements of the shoe during use. It is a polymer in solution, i.e., diluted in a solvent such as water (for example, latex diluted in water) or in an organic solvent, for polyurethane, polyvinyl chloride, silicone.

The solvent is used to liquefy the polymer for its application, either with a brush, or by spraying. The magnitude of the viscosity of the polymer in solution is adapted to the selected application method; thus, the solution is more viscous for an application with a brush, paint brush, whereas the solution is more fluid for an application by spraying, for example, with a spray gun.

The solvent evaporates during the drying phase, which can occur naturally, or can be initiated by ventilation/heating means. The polymer can also be liquefied by heating and then solidifies upon cooling.

Other polymers, such as thermoplastic- or polyamide-base impact polystyrenes can also be used. Polyurethane is a preferred polymer for its excellent qualities of semi-rigidity, adhesiveness, low temperature stability, excellent abrasion resistance.

The aforementioned other polymers are also very interesting if less restricting mechanical qualities are desired.

The number of polymer layers applied also depends on the desired characteristics of abrasion resistance, imperviousness, appearance, etc. Subsequently, reference will be made to a layer, even if the latter is obtained by several successive applications.

Similarly, quantities of rubber, graphite, dye, glass fiber, etc., can be added to the polymer to improve adherence, abrasion resistance, the aesthetic aspect.

As the polymer layer is applied on the assembled shoe with a brush or by spraying, all of the aesthetic effects on the shoe, such as waviness, etc., can be obtained.

Thus, in the example shown in FIG. 1, the layer 3 rises toward the front of the shoe along a curved line 3*a,* and toward the rear of the shoe along a curved line 3*b*. In other words, according to the invention, the polymer layer 3 can be applied to have an upper edge that extends along a line varying in height along a length of the upper.

This application method especially has the important advantage of avoiding the horizontal straight line effects resulting from an application by immersion in a bath, and therefore enables a markedly improved aesthetic effect.

The layer 3 can be applied on the shoe upper in predetermined areas to increase adherence, imperviousness, abrasion resistance, or to obtain a particular aesthetic effect.

According to a preferred embodiment, the polymer layer 3 is peripherally applied on the shoe in the form of a strip, simultaneously straddling the upper 1 and the outer sole 2.

Thus, as shown more particularly in FIG. 2, the polymer strip 3 covers the junction line 4 between the upper 1 and the sole 2, and extends on both sides of this line 4 on both the upper 1 and the sole 2. As a result, the polymer strip 3 makes it possible to guarantee a perfect sealing of the upper/sole junction. It can be applied more or less high on the upper depending on the degree of imperviousness desired for the shoe.

Depending on the desired aesthetic effect, the polymer strip 3 is applied on the shoe after hiding, with appropriate covers, the zones that one does not wish to be coated. This makes it possible to have a clean demarcation between the covered zones and the uncovered zones, If, conversely, one wishes to have a faded effect between the covered zones and the uncovered zones, the covers are eliminated.

FIG. 3 shows another embodiment in which the polymer layer 3 is applied on a very ventilated or aeratable material of the upper 1, such as a mesh. A mesh is used to make ventilated very lightweight shoes; the disadvantage of this type of material, obtained by knitting, is that it is very fragile and sensitive to abrasion.

It is surprisingly noted that a polymer layer applied on the meshed textile material considerably improves the abrasion resistance of this material, without preventing air from passing through, and therefore preserving the breathability of the material.

Preferably, the mesh used is a so-called three-dimensional mesh, i.e., a material constituted, as shown in FIG. 4, of two parallel sides or layers laps 11, 12, of fabric connected together and kept at a distance from one another by a median layer of fibers 13 extending essentially perpendicular to the plane constituted by each of these sides and defining an elastically compressible air space between these two layers 11, 12. Such a three-dimensional textile material is generally made during the same manufacturing step. It can also be constituted by means of two laps of fabric obtained separately, and connected subsequently by a ventilated layer along its thickness.

The two sides 11, 12 are preferably constituted by layers of meshed fabric or jersey; they can also be constituted by layers of woven or nonwoven fibers.

In the case of a three-dimensional meshed material 10, the polymer layer 3 is applied on the outer side 11 and therefore improves the wear resistance thereof, without hindering the passage of air A through the inner side 12 and the lap of fibers 13 (see arrows A).

In the present case, the outer side 11 of the fabric 10 can even be made completely watertight by applying a polymer layer of sufficient thickness, without limiting the breathability since air can escape by the median layer 13 (see arrows A).

In any event, the polymer layer 3 at least partially renders the fabric impervious, and particularly "impervious" to the penetration of stones, sand.

The coating of the polymer 3 does not stop necessarily to the first side 11, depending in particular on the viscosity of the polymer 3 and the size of the holes of the mesh constituting this first side.

Depending on the more or less substantial penetration of the polymer inside the three-dimensional material, this material will be more or less watertight.

According to a preferred embodiment, the meshed material of the outer side 11 has small holes to ensure that the polymer coating does not penetrate too far into the fabric. In this case, the inner side 12 is advantageously made of a meshed fabric with large holes to promote ventilation.

Preferably, as in the embodiment of the invention described above, the polymer layer is applied so as to straddle the junction line 4 between the sole 2 and the upper 1.

The present invention is not limited to the embodiment described hereinabove by way of a non-limiting example, but encompasses all similar or equivalent embodiments.

What is claimed is:

1. A method of manufacturing an article of footwear comprising an upper and a sole, said method comprising:

assembling the upper on the sole;

preparing a quantity of flexible or semi-rigid polymer in a liquid state by diluting the polymer in a solvent;

applying at least one layer of the flexible or semi-rigid liquid polymer in predetermined areas of the upper, said predetermined areas constituting less than an entirety of the upper;

drying the article of footwear;

the method of manufacturing thereby resulting in less than the entirety of the upper having any polymer coating.

2. A method of manufacturing an article of footwear according to claim 1, wherein said applying of the polymer comprises applying the polymer with a brush.

3. A method of manufacturing an article of footwear according to claim 1, wherein said applying of the polymer comprises applying the polymer by spraying.

4. A method of manufacturing an article of footwear according to claim 1, wherein said applying the polymer comprises applying the polymer so as to straddle the upper and the sole.

5. A method of manufacturing an article of footwear according to claim 1, further comprising liquefying the polymer by heating.

6. A method of manufacturing an article of footwear according to claim 1, wherein the polymer comprises one of the following polymers: latex, polyurethane, PVC, silicone, polyamide, synthetic rubber, thermoplastic-base impact polystyrene.

7. An article of footwear comprising:

an upper and an outer sole, said upper being assembled on said sole;

at least one layer of flexible or semi-rigid polymer having been applied in a liquid state to coat predetermined areas of the upper, said predetermined areas constituting less than an entirety of the upper, whereafter said polymer is allowed to dry and less than the entirety of the upper has any polymer coating.

8. An article of footwear according to claim 7, wherein the polymer layer comprises a strip applied to said upper and said outer sole to simultaneously straddle said upper and said outer sole.

9. An article of footwear according to claim 8, wherein the polymer comprises one of the following polymers: latex, polyurethane, PVC, silicone, polyamide, synthetic rubber, thermoplastic-base impact polystyrene.

10. An article of footwear according to claim 9, wherein the upper comprises a mesh material.

11. An article of footwear according to claim 10, wherein the upper comprises a three-dimensional mesh material.

12. A method of manufacturing an article of footwear, said method comprising:

assembling an upper onto an outer sole, said upper comprising an aeratable material, said aeratable material of said upper having an outer side and an inner side;

preparing a quantity of liquid polymer by diluting a polymer in a solvent;

applying at least one layer of the liquid polymer to less than an entirety of said outer side of said aeratable material of said upper to thereby allow ventilation through said aeratable material after completion of manufacture of the article of footwear;

drying said article of footwear;

the method of manufacturing thereby resulting in less than the entirety of the upper having any polymer coating.

13. A method of manufacturing an article of footwear according to claim 12, wherein:

said aeratable material comprises a three-dimensional mesh material, said three-dimensional mesh material comprising a pair of spaced-apart layers of mesh fabric and an elastically compressible air space between said pair of spaced-apart layers.

14. A method of manufacturing an article of footwear according to claim 12, wherein:

said aeratable material comprises a three-dimensional mesh material, said three-dimensional mesh material comprising a pair of spaced-apart layers of mesh fabric and a fibrous layer between said pair of spaced-apart layers.

15. A method of manufacturing an article of footwear according to claim 12, wherein:

said applying at least one layer of a liquid polymer to less than an entirety of said outer side of said upper comprises applying said polymer to create a polymer layer having an upper edge extending along a line varying in height along a length of said upper.

16. A method of manufacturing an article of footwear according to claim 15, wherein:

said upper edge of said polymer layer rises in height at least along a rear of said upper.

17. A method of manufacturing an article of footwear according to claim 12, further comprising:

applying said at least one layer of said liquid polymer to less than an entirety of said sole, whereby said layer of liquid polymer covers a junction between said upper and said sole.

18. A method of manufacturing an article of footwear, said method comprising:

assembling an upper onto an outer sole, said upper comprising an aeratable material, said aeratable material of said upper having an outer side and an inner side;

preparing a quantity of liquid polymer by diluting a polymer in a solvent;

applying at least one layer of the liquid polymer to said outer side of said aeratable material of said upper to create a polymer layer having an upper edge extending along a line varying in height along a length of said upper;

drying said article of footwear;

the method of manufacturing thereby resulting in less than the entirety of the upper having any polymer coating.

19. A method of manufacturing an article of footwear according to claim 18, wherein:

said upper edge of said polymer layer rises in height at least along a rear of said upper.

20. An article of footwear comprising:

an outer sole;

an upper affixed to said outer sole, said upper comprising an aeratable material, said aeratable material of said upper having an outer side and an inner side;

at least one layer of a polymer covering less than an entirety of said outer side of said aeratable material of said upper to thereby allow ventilation through said aeratable material, whereby less than the entirety of the upper has any polymer coating.

21. An article of footwear according to claim 20, wherein:

said aeratable material comprises a three-dimensional mesh material, said three-dimensional mesh material comprising a pair of spaced-apart layers of mesh fabric and a fibrous layer between said pair of spaced-apart layers.

22. An article of footwear according to claim 20, wherein:

said aeratable material comprises a three-dimensional mesh material, said three-dimensional mesh material comprising a pair of spaced-apart layers of mesh fabric and an elastically compressible air space between said pair of spaced-apart layers.

23. An article of footwear according to claim 20, wherein:

said at least one layer of a polymer comprises an upper edge extending along a line varying in height along a length of said upper.

24. An article of footwear according to claim 23, wherein:

said upper edge of said polymer layer rises in height at least along a rear of said upper.

25. An article of footwear according to claim 20, wherein:

said at least one layer of polymer also covers part of but less than an entirety of said sole, whereby said layer of polymer covers a junction between said upper and said sole.

26. An article of footwear according to claim 20, wherein:

said polymer is latex.

27. An article of footwear according to claim 20, wherein:

said polymer is polyurethane.

28. An article of footwear according to claim 20, wherein:

said polymer is PVC.

29. An article of footwear according to claim 20, wherein:

said polymer is silicone.

30. An article of footwear according to claim 20, wherein: said polymer is polyamide.

31. An article of footwear according to claim 20, wherein: said polymer is synthetic rubber.

32. An article of footwear according to claim 20, wherein: said polymer is a thermoplastic-base impact polystyrene.

33. An article of footwear comprising:

an outer sole;

an upper affixed to said outer sole, said upper comprising an aeratable material, said aeratable material of said upper having an outer side and an inner side;

at least one layer of a polymer affixed to said outer side of said aeratable material of said upper, said layer of polymer having an upper edge extending along a line varying in height along a length of said upper;

less than an entirety of the upper having any polymer coating.

34. An article of footwear according to claim 33, wherein: said upper edge of said polymer layer rises in height at least along a rear of said upper.

* * * * *